US006082871A

United States Patent [19]

Yeh

[11] Patent Number: 6,082,871

[45] Date of Patent: Jul. 4, 2000

[54] CEILING LIGHT

[76] Inventor: Neng-Chen Yeh, No. 10, Lane 808, Chungshan Rd., Hsinhua Chen, Tainan Hsien, Taiwan

[21] Appl. No.: 09/225,605

[22] Filed: Jan. 5, 1999

[51] Int. Cl.[7] ..... F21S 1/02

[52] U.S. Cl. ..... 362/147; 362/324; 362/284

[58] Field of Search ..... 362/147, 148, 362/154, 155–282, 284, 288, 374, 375, 322, 324

[56] References Cited

U.S. PATENT DOCUMENTS

| | | | |
|---|---|---|---|
| 4,142,227 | 2/1979 | Aikens | 362/480 |
| 5,222,801 | 6/1993 | Neer | 362/148 |
| 5,377,087 | 12/1994 | Yoon | 362/275 |
| 5,404,297 | 4/1995 | Birk | 362/421 |

*Primary Examiner*—Sandra O'Shea
*Assistant Examiner*—Hargobind S. Sawhney
*Attorney, Agent, or Firm*—Thorp Reed & Armstrong, LLP

[57] ABSTRACT

The present invention provides a ceiling light composed of a base, a cover, a shade seat, a shade cover, a shade, an adjusting seat and other elements. The base is circle shape and has a recessed section defined therein which holds the shade seat therein. An elongated arcuate hole is defined in the shade with an upper washer and a lower washer. A spring is secured between the lower washer and the recessed section, and the upper washer, shade seat, the lower washer, the spring and the base are held together by a rivet. After the shade cover has been directly fastened on the upper end of the shade, the illumination direction can be changed by pushing the shade cover. Thereby, not only can the illumination direction of the light be easily adjusted to any direction, but also the wires can not be tangled together.

5 Claims, 6 Drawing Sheets

CEILING LIGHT

BACKGROUND OF THE INVENTION

1. Field of the Invention

The present invention relates to a ceiling light, and more particularly to a light shade that facilitates adjusting the illumination direction thereof.

2. Description of the Related Art

There are many kinds of ceiling lights available, wherein, the ceiling light embedded in the ceiling or a chest is especially popular because of its dual function of illumination and adornment.

Generally, there are two types of ceiling lights; flush mounted and surface mounted. However, both of these two types of ceiling lights have a common drawback, that is, the illumination direction is constant and unchangeable. As seen in FIG. 7, after the ceiling light is installed, its illumination direction is perpendicular to the plane where it is positioned, and it is impossible to change the illumination direction.

There are many types of ceiling lights that can adjust their illumination direction. The conventional adjustable ceiling light is constituted of an outer cylinder, an inner cylinder and a shade cover. The inner cylinder is rotatably fixed in the outer cylinder and has a bulb secured therein. The shade cover is mounted in the front of the inner cylinder. The shade cover is pivotally fastened to the inner cylinder by two pivot poles on two sides thereof. Therefore, the shade cover can pivot by using the pivot pole as a moving center. If a user wants to change the illumination direction of the ceiling light, at first, the user should rotate the inner cylinder to a suitable position, then, push the shade cover to change the alignment angle of the ceiling shade cover, thereby, the illumination direction is changed.

Although the structure described above can adjust the illumination direction of the ceiling light, it is not convenient for a user to do it because the user must rotate the inner cylinder and push the shade cover at the same time. Repeated adjustment may make the electrical wires become twisted. It is also not very convenient because the inner cylinder and the wires are held in the outer cylinder, and the user will not be able to examine the status of the wires. Another ceiling light available in the present market as shown in FIGS. 8 and 9 solves these problems. Referring to FIGS. 8 and 9, the ceiling light comprises a disk seat (80) having a through-hole (81) defined in the center thereof, an elastic locator (82) embedded around the inner circumference of the through-hole (81) and having an arcuate hole (821), a shade cover (83) fastened to the arcuate hole (821) and having a spherical body (831), a bulb (832) mounted in the body (831) and connected with a set of wires (833)., the skirt end of the ceiling light shade cover (83) is covered. If the user wants to adjust the illumination direction after the ceiling light has been installed , the user must rotate the shade cover (83) directly by moving the body (831) within the arcuate hole (821).

Although the illumination direction of the ceiling light as shown in FIGS. 8 and 9 can be adjusted freely, the engagement between the body (831) and the hole (821) is not secure. When the spherical body (831) is held tightly in the arcuate hole (821), it is difficult to adjust illumination direction. On the contrary, if the engagement between the body (831) and the arcuate hole (821) is not tight enough, the body (831) will move from the pressure of twisted wires (833) or even vibrations. Other than the two problems above, when the ceiling light shade is adjusted, the wires are twisted together.

The present is intended to mitigate or obviate the foregoing problems.

SUMMARY OF THE INVENTION

The main object of the present invention is providing a ceiling light composed of a base, a cover, a light shade seat, a light shade cover, a shade, an adjusting seat and other elements to overcome the problems associated with the conventional ceiling light. The base is circular shaped and has a recessed section defined therein which holds the ceiling light shade seat therein. An elongated arcuate hole is defined in the light shade with an upper washer and a lower washer. A spring is secured between the lower washer and the recessed section, and the upper washer, ceiling light shade seat, and the lower washer are connected by a rivet. After the shade cover has been directly fastened on the upper end of the shade, the illumination direction can be changed by pushing the shade cover. Thereby, not only can the illumination direction of the ceiling light be easily adjusted in any direction, but the wires will not be tangled.

DESCRIPTION OF THE PREFERRED EMBODIMENT

Figure 1:
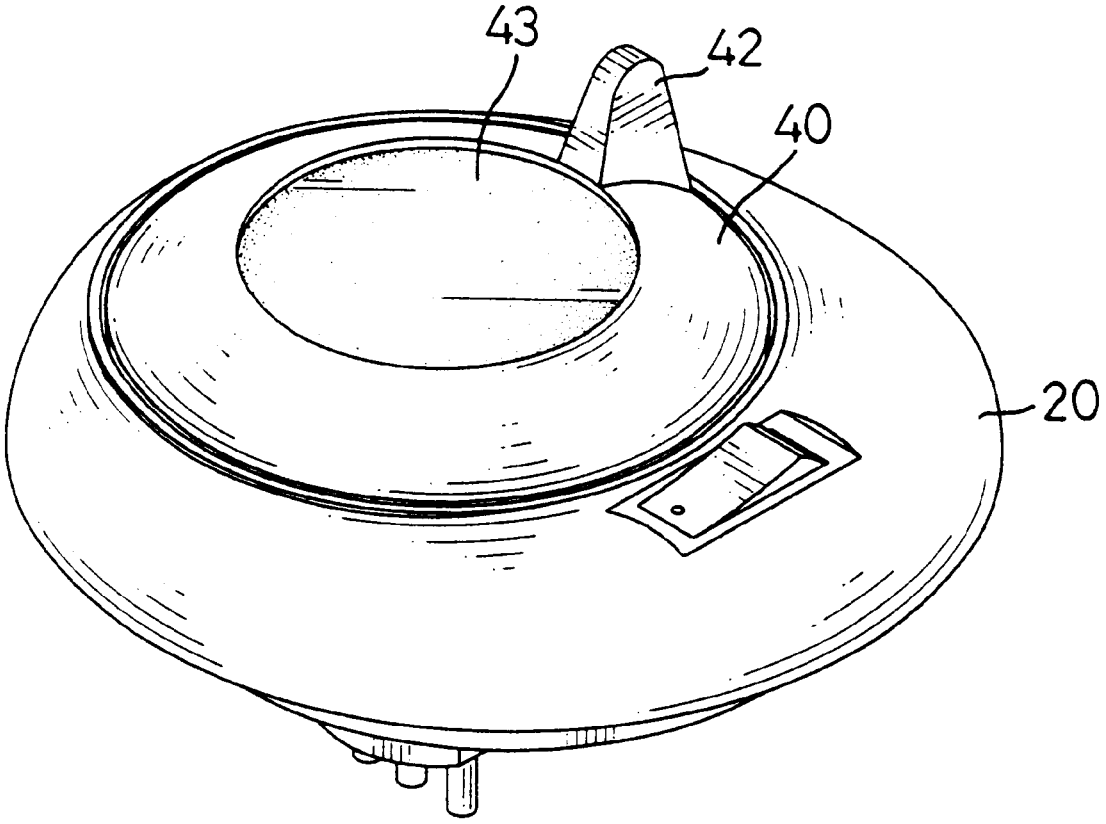
FIG. 1 is a perspective view of the ceiling light of the present invention.
Figure 2:
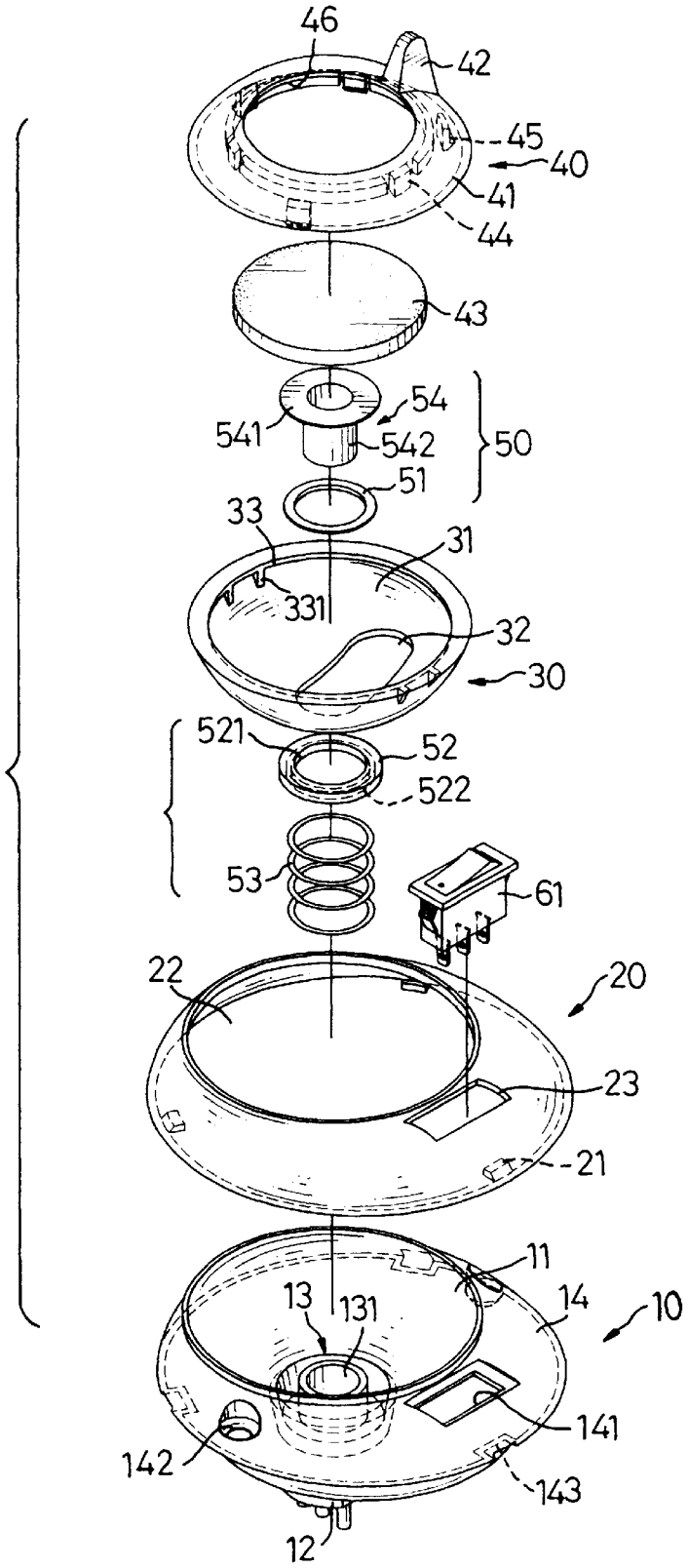
FIG. 2 is an exploded perspective view of the ceiling light of the present invention.
Figure 7:
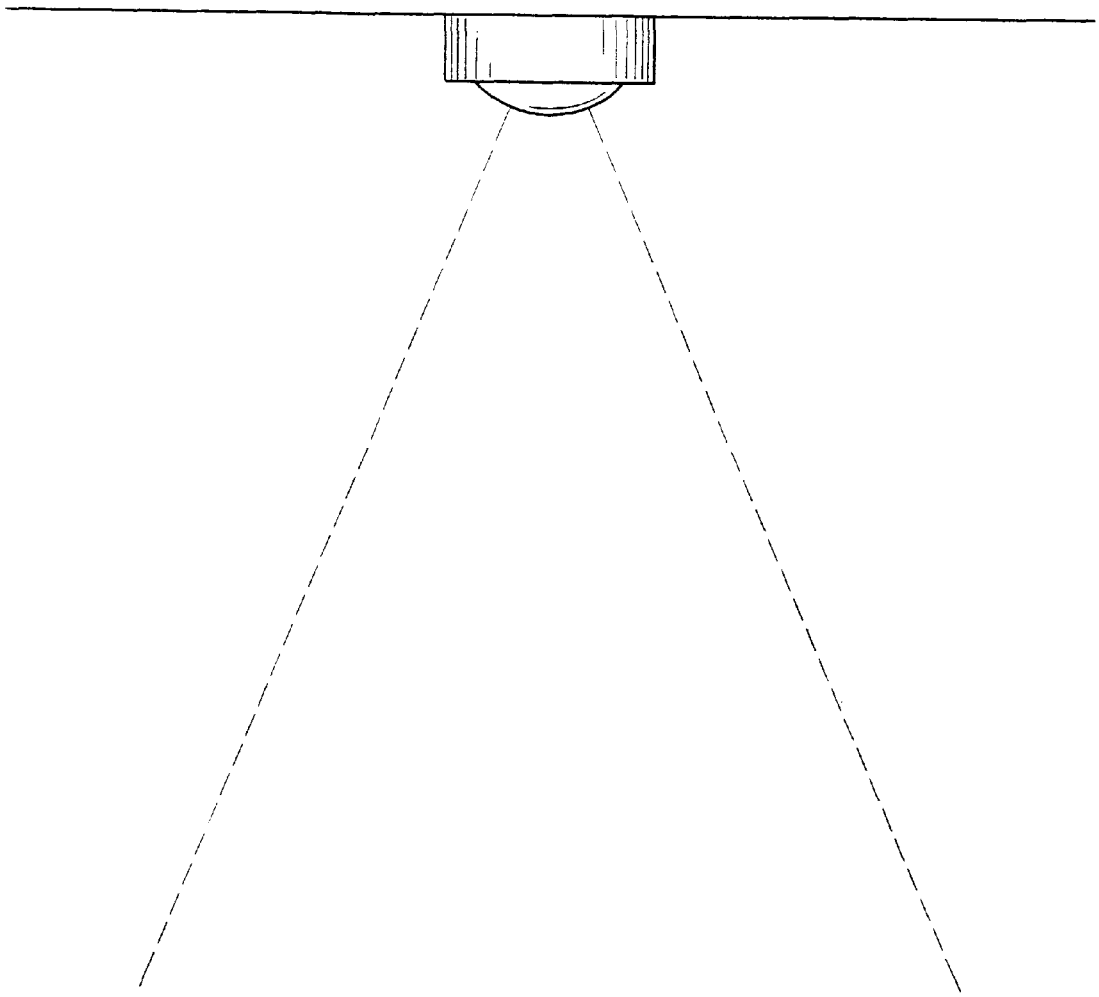
FIG.7 PRIOR ART
FIG. 7 is a schematic view showing the relationship between the plane where a conventional ceiling light is located and the direction of the illumination of the light.
Figure 8:
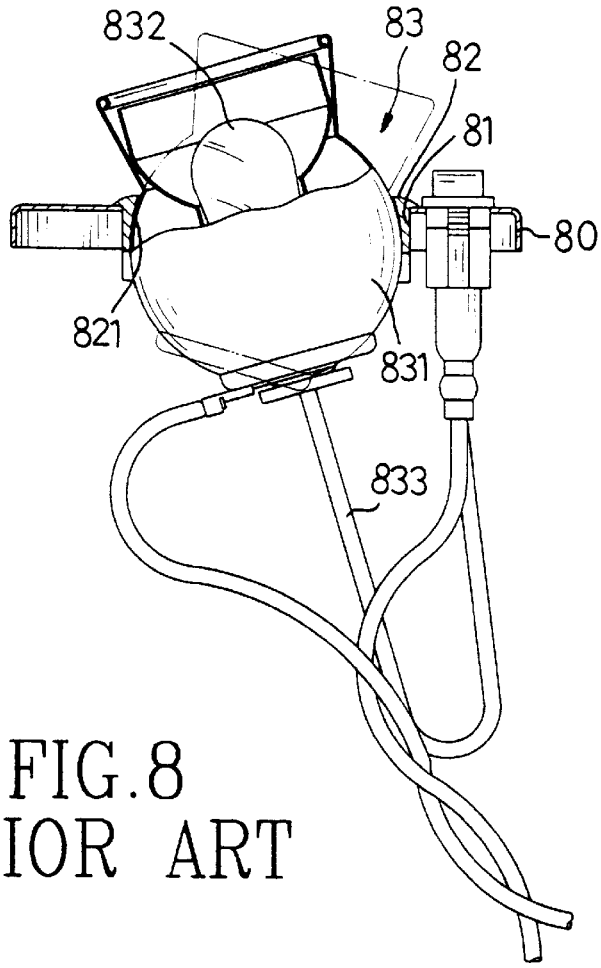
FIG.8 PRIOR ART
FIG. 8 is a side view in partial section of a second conventional ceiling light.
Figure 9:
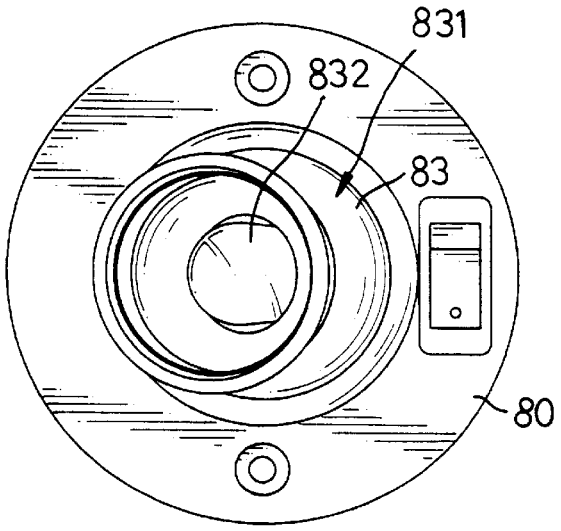
FIG.9 PRIOR ART
FIG. 9 is a schematic bottom perspective view of the second conventional ceiling light shown in FIG. 8.

Referring to FIG. 1 and 2, the ceiling light according to the present invention comprises a base (10), a cover (20), a shade seat (30), a shade cover (40), an adjusting seat (50) and a switch (61). If there is no preinstalled hole in a ceiling, the ceiling light according to the present invention can be mounted on the ceiling surface with the aid of a mounting seat (70) as shown in FIG. 7.

The base (10) includes a recess (11) defined therein, a bulged pole (13) mounted on the center of the bottom defining the recess (11) and having a central hole (131) defined therein, a power pack (12) attached to the lower end of the base (10), and an arcuate flange (14) having a switch hole (141), an opposed pair of mutually corresponding openings (142) and a set of gaps (143) peripherally defined in the edge of the arcuate flange (14).

The cover (20) comprises a set of keys (21) formed on the lower edge thereof and corresponding to the gaps (143), a central through-hole (22) defined therein and a switch hole (23) defined therein and used to receive the switch (61).

The ceiling light shade seat (30) includes a holding space (31) with an elongated arcuate hole (32) defined in the bottom face defining the holding space (31), and a flange (33) peripherally formed on the inner edge of the holding space (31) and having two mutually corresponding pairs of stiffeners (331).

The shade cover (40) includes an arcuate ledge surface (41), a driving piece (42) formed on the arcuate ledge surface (41), a central through-hole (46) defined therein, a bulb cover (43) made from a kind of transparent or semi-transparent material whose diameter is designed to be engaged in the central hole (46), and two sets of clips (44, 45) formed below the arcuate ledge surface (41) and at positions with different diameters, wherein, the outer clip (45) lies at a larger diameter position, and the inner clip (44) lies at a smaller diameter position and is use to fasten the bulb cover (43) onto the central hole (46) of the shade cover (40).

The adjusting seat (50) includes an upper washer (51) having a curved bottom, a lower washer (52) having an upper curved surface (521) used to be fitted with the ceiling light shade seat (30) and a annular recess (522) defined in the lower face thereof, a spring (53) and a rivet (54) having a flange (541) on the upper end and a skirt (542) on the lower end. The diameter of the spring (53) is equal to that of the recess (522) so that the upper end of the spring (53) can be seated in the recess (522) of the lower washer (52).

Figure 3:
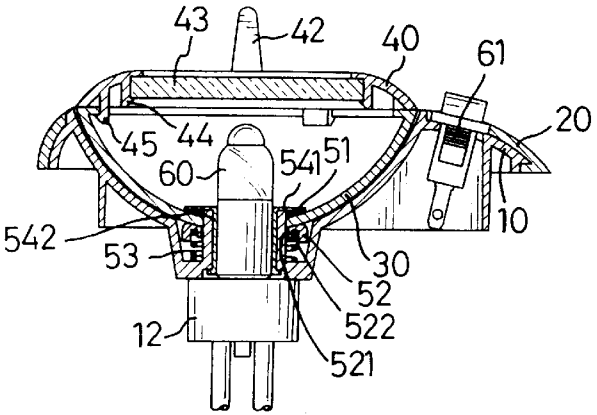
FIG. 3 is a side view in partial section of the ceiling light of the present invention.
Figure 6:
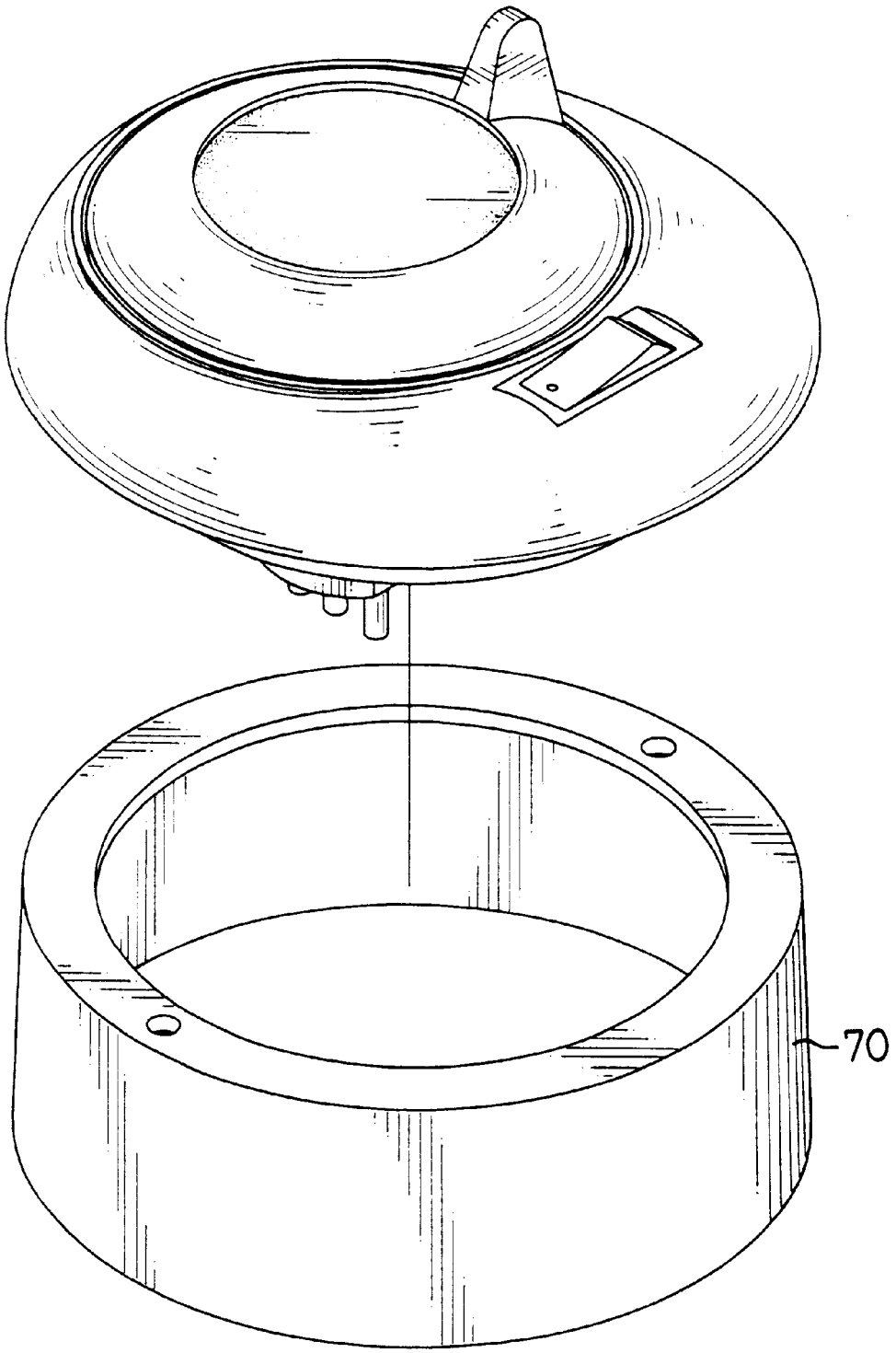
FIG. 6 is an exploded perspective view showing the mounting seat of the ceiling light of the invention.

Referring to FIGS. 2 and 3, during assembly, the spring (53) is first put in the recess (11) and around the bulged pole (13). the lower washer (52) is then placed on top of the spring (53)with the upper end of the spring (53) seated in the annular recess (522) of the lower washer (52)and the bottom of the spring (53) seated in the recess (11) and around the pole (13). thirdly, the shade seat (30) is positioned in the recess (11). the upper washer (51) is then placed on the elongated arcuate hole (32). afterwhich, the rivet (54) is inserted into the bulged pole (13) through the upper washer (51), the shade seat (30), the lower washer (52) and the spring (53) and rivets them together. Then, the bulb (60) is inserted into the rivet (54), and the cover (20) is fastened onto the base (10) via the snap fit between the keys (21) and the gaps (143) in the flange (14). The shade cover (40) is then clipped with the cover (20) via the snap fit between the outer clip (45) and the flange (33). Finally, the switch (61) selectively and electrically connected with the bulb (60) is inserted into the switch holes (23, 141), and the power pack (12) electrically connected with the switch (60) is fastened to the lower end of the bulged pole (13) ofthe base (10). Because the ceiling light shade seat (30) is engaged with the base (10) by means of the abutment of the spring (53), the shade seat (30) is rotatable with respect to the base (10).

Figure 5:
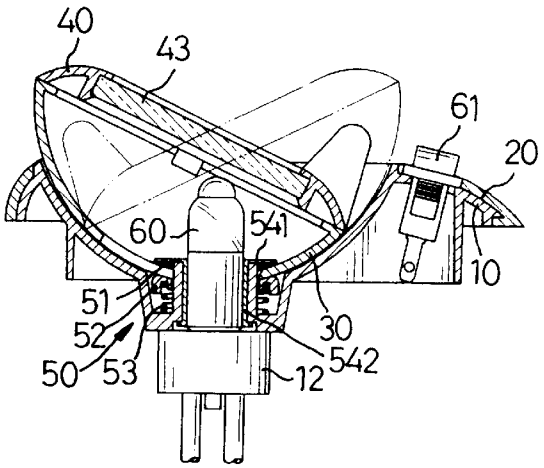
FIG. 5 is a side view in partial section showing the adjustment of the illumination direction of the invention.
Figure 4:
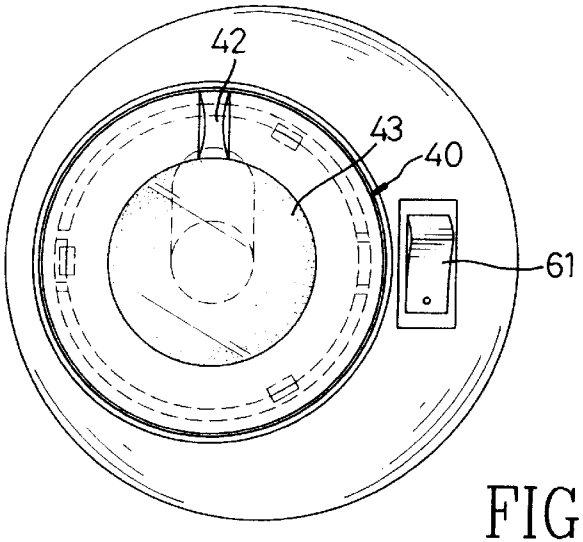
FIG. 4 is a top plan view of the ceiling light of the present invention.

In operation, as shown in FIG. 5, if a user wants to adjust the illumination direction of the ceiling light according to present invention, the user can turn the driving piece (42) on the arcuate ledge surface (41) of the ceiling light shade cover (40) to rotate the ceiling light shade cover (40) and the cover (20) because of the connection between the ceiling light shade cover (40) and the cover (20). When the illumination direction is adjusted, the ceiling light will be stable, because of the biasing force of the spring (53). The illumination direction of the ceiling light according to the present invention can be adjusted to any direction because of the combination of the shade seat (30) and the cover (20), and the design of the elongated arcuate hole (32) in the shade seat (30).

The ceiling light according to the present invention has the following advantages:

1. The illumination direction of the ceiling light can be adjusted to any direction by just a single action;
2. When the illumination is adjusted, the ceiling light will be stable because of the biasing force of the spring (53);
3. The wires of the power pack (12) will not be tangled because the bulb in the ceiling light according to the present invention does not rotate when the illumination direction is adjusted; and
4. The illumination direction can easily be adjusted because the user does not need to touch the hot light shade.

From the foregoing, it is seen that the objects herein before set forth may readily and efficiently be attained, and since certain changes may be made in the above construction and different embodiments of the present invention without departing from the scope thereof, it is intended that all matters contained in the above description or shown in the accompanying drawings shall be interpreted as illustrative and not in a limiting sense.

What is claimed is:

1. An improved ceiling light comprising:

a base having a recess, a bulged pole mounted on a bottom defining the recess and having a central hole defined therein, a power pack attached to a lower end thereof, and an arcuate flange having a first switch hole, an opposed pair of mutually corresponding openings and a set of gaps peripherally defined in an edge thereof;

a cover snap fitted to and detachably connected with the base and having a set of keys formed on a lower edge thereof and corresponding to the gaps of the base, a central through-hole defined therein and a second switch hole corresponding to the first switch hole;

a shade seat seated on top of the central through-hole of the cover and having a holding space defined in a center thereof, an elongated arcuate hole defined in a bottom face defining the holding space and corresponding to the central hole of the bulged pole, and a flange peripherally formed on an inner edge of the holding space and having two mutually corresponding pairs of stiffeners;

a shade cover having an arcuate ledge surface, a driving piece formed on the arcuate ledge surface, a central through-hole defined therein, and two sets of clips formed below the arcuate ledge surface and at positions with different diameters, wherein, a set of clips bearing with a smaller diameter is used to allow the bulb cover to be forced to be fastened onto the central through hole of the shade cover; and an adjusting seat having an upper washer provided with a curved bottom, a lower washer having an upper curved surface used to be fit with the shade seat and an annular recess defined in a lower face thereof, a spring received between the annular recess of the lower washer and the bottom of the recess of the base and a rivet having a flange on the upper end for engaging with the upper washer and a downward extending skirt on the lower end for extending through the upper washer, the elongated arcuate hole of the seat, the lower washer, the spring, the central through-hole of the cover and into the bulged pole.

2. The ceiling light as claimed in claim 1, wherein, the cover is aligned and secured with the base by a set of keys formed on a bottom face of the cover.

3. The ceiling light as claimed in claim 1, wherein, the set of clips bearing a larger diameter are formed on a bottom of the shade cover.

4. The ceiling light as claimed in claim 3, wherein the base has a set of gaps corresponding to the set of clips of the shade cover, such that the base is secured with the shade cover by the engagement between the set of clips and the gaps.

5. The ceiling light as claimed in claim 1, wherein, a bulb cover is made from a transparent material and is secured together with the shade by a set of clips formed beneath the ceiling light shade.

* * * * *